US007914309B2

(12) United States Patent
Chazottes et al.

(10) Patent No.: US 7,914,309 B2
(45) Date of Patent: Mar. 29, 2011

(54) ELECTRICAL CONNECTOR COMPRISING A MAT SEAL AND A RAMP SYSTEM FOR COMPRESSING THE MAT SEAL

(75) Inventors: Frédéric Chazottes, Houx (FR); Christian Campfort, Fresnay le Gilmert (FR); Thierry Leguay, Maintenon (FR); Michel Aeschbacher, Saint-prest (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/450,261

(22) PCT Filed: Mar. 20, 2007

(86) PCT No.: PCT/IB2007/051436

§ 371 (c)(1),
(2), (4) Date: Nov. 16, 2009

(87) PCT Pub. No.: WO2008/114100

PCT Pub. Date: Sep. 25, 2008

(65) Prior Publication Data

US 2010/0075524 A1 Mar. 25, 2010

(51) Int. Cl.
*H01R 13/52* (2006.01)

(52) U.S. Cl. ..... 439/275

(58) Field of Classification Search ..... 439/275, 439/271–274, 587
See application file for complete search history.

(56) References Cited

U.S. PATENT DOCUMENTS

| | | | | |
|---|---|---|---|---|
| 6,071,147 | A | 6/2000 | Tsukamoto | 439/587 |
| 6,116,938 | A * | 9/2000 | Myer et al. | 439/353 |
| 6,752,659 | B2 * | 6/2004 | Nakamura et al. | 439/587 |
| 7,056,137 | B1 * | 6/2006 | Vall Gendre et al. | 439/271 |
| 7,354,308 | B2 * | 4/2008 | Iwahori | 439/587 |
| 2010/0075524 | A1 * | 3/2010 | Chazottes et al. | 439/275 |

FOREIGN PATENT DOCUMENTS

| | | |
|---|---|---|
| EP | 1 926 415 A1 | 3/2003 |
| JP | 2005-123102 | 12/2005 |

* cited by examiner

*Primary Examiner* — Chandrika Prasad
(74) *Attorney, Agent, or Firm* — Harrington & Smith

(57) ABSTRACT

The electrical connector includes an insulative housing having a rear skirt extending rearward with respect to the rear face of the insulative housing, a mat seal disposed in the rear skirt against the rear face, a rear grid, disposed in the rear skirt, against the mat seal. The electrical connector includes a mobile part, a guide rail that is transverse to the front-rear direction (XX'), for transversally guiding the mobile part, and a ramp system such that, when the mobile part is guided by the guide rail, the ramp system pushes the rear grid against the mat seal so as to compress the mat seal.

14 Claims, 4 Drawing Sheets

ELECTRICAL CONNECTOR COMPRISING A MAT SEAL AND A RAMP SYSTEM FOR COMPRESSING THE MAT SEAL

FIELD OF THE INVENTION

The present invention relates to electrical connectors with a mat seal.

EP-A1-1 296 415 describes an electrical connector of the type comprising:

- an insulative housing having:
  - a front face for being mated with a counterpart electrical connector, and
  - a rear face for inserting cable terminals,
  - a plurality of terminal accommodating chambers, which each open on the rear face for inserting of a respective cable terminal, and on the front face so that the respective cable terminal accommodated in the accommodating chamber can be connected to a counterpart terminal of the counterpart connector,
  - a rear skirt extending rearward with respect to the rear face,
- a mat seal disposed in the rear skirt against the rear face, and having a plurality of cable passages facing the accommodating chambers,
- a rear grid, disposed in the rear skirt, against the mat seal, and having a plurality of cable passages facing the cable passages of the mat seal.

In the known electrical connector, the insulative housing comprises a housing body and a contact carrier, able to slide on each other.

For assembling the known electrical connector, cables are introduced through the mat seal for accommodating the terminals in the accommodating chambers arranged in the contact carrier. The known electrical connector comprises rotatory lever system for locking the connector to a counterpart connector. The lever system is arranged so that, when activated, it brings the housing body closer to the contact carrier. The housing body thus drags along the rear grid so that the rear grid compresses the mat seal.

This longitudinal compression leads to a shrinking of the cable passages of the mat seal, so that efficient sealing with the cables are obtained.

SUMMARY OF THE INVENTION

The invention proposes an electrical connector arranged so that an alternative assembling is possible.

Accordingly, the invention relates to an electrical connector of the previous type, comprising:

- a mobile part,
- a guide rail fixed to the housing, the guide rail being transverse to the front-rear direction, for transversally guiding the mobile part,
- a ramp system such that, when the mobile part is guided by the guide rail, the ramp system pushes the rear grid against the mat seal so as to compress the mat seal.

In the electrical connector of the invention, the mounting of the mobile part automatically leads to the compressing of the mat seal. In this way, the sealing of the cables occurs when the connector is assembled.

Other embodiments of the invention correspond to the features of claims 2 to 7 considered either separately or in combination.

BRIEF DESCRIPTION OF THE DRAWINGS

The invention will be better understood by reading the following description of a non limitative exemplary embodiment, referring to the drawings in which.

DETAILED DESCRIPTION OF A PREFERRED EMBODIMENT

Figure 1:
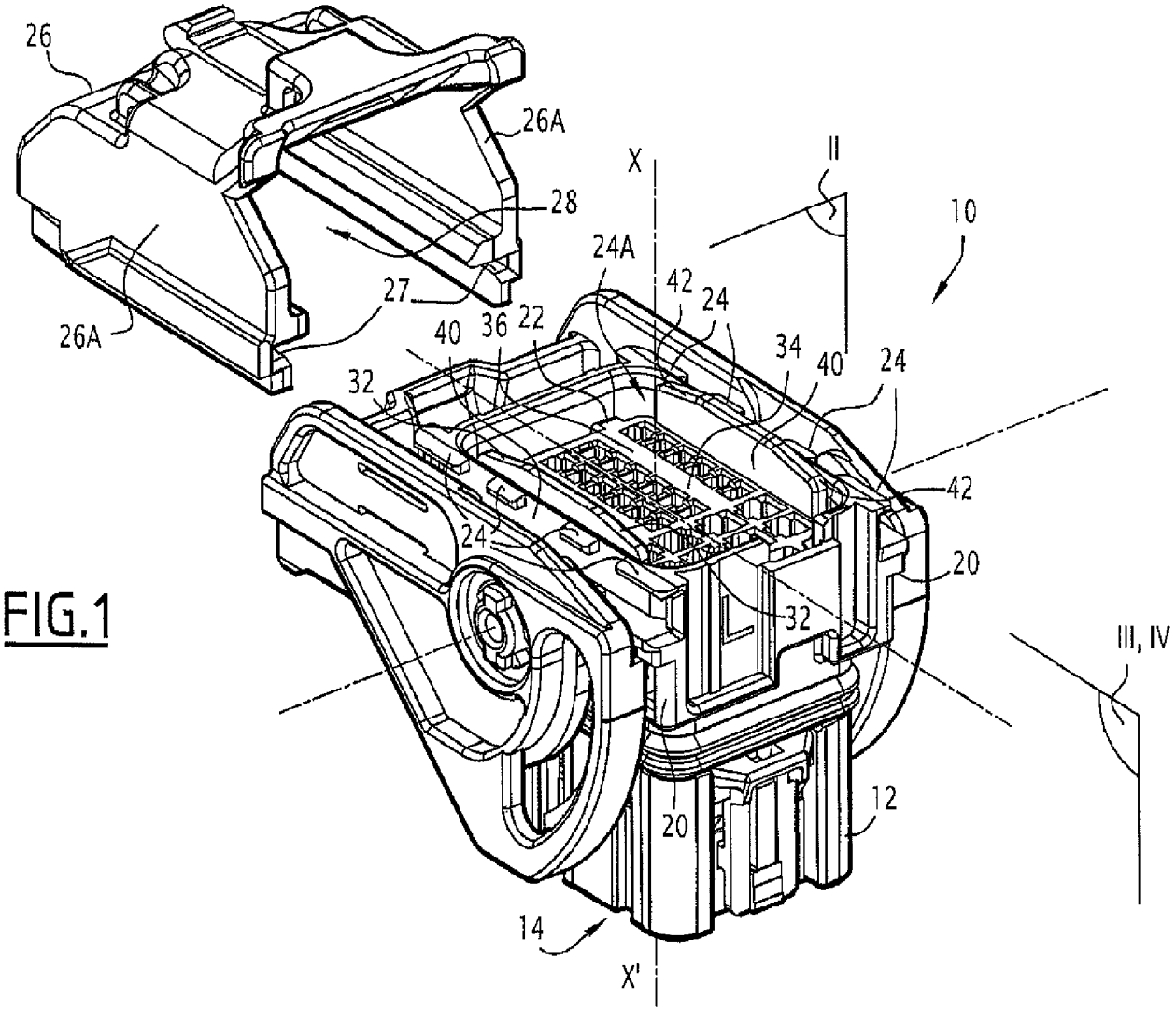
FIG. 1 is tri-dimensional view of an electrical connector according to the invention, before being assembled.

Turning to the figures, an electrical connector 10 according to the invention is depicted.

The electrical connector 10 is a male connector of a type used in automotive applications, intended to mate with a counterpart female connector. In an alternative embodiment, the electrical connector according to the invention could be a female connector intended to mate with a counterpart male connector.

For the sake of clarity, the figures are orientated according to an XX' axis, which stands for the mating direction. Every direction- or orientation related term in the following description, in particular the terms "rear" and "front", refer to the XX' axis.

The electrical connector 10 comprises an insulative housing 12, usually made of a plastic material. The insulative housing 12 is essentially constituted of a parallelepiped having a front face 14 for being mated with a counterpart female electrical connector (not shown), and a rear face 16 (visible on FIGS. 2, 3 and 4) for inserting cable terminals (not shown).

A plurality of accommodating chambers 18 are formed in the insulative housing 12. Each accommodating chamber 18 opens, first on the rear face 16 for inserting a respective cable terminal, and second on the front face 14 so that the respective cable terminal accommodated in the accommodating chamber 18 can be connected to a counterpart terminal (not shown), of the counterpart connector.

A rear skirt 20 extends rearward with respect to the rear face 16. Preferably, the rear skirt 20 is made integral with the housing 12, in a single molding process. The rear skirt 20 defines a substantially rectangular rear aperture 22, located opposite the insulative housing 12. The rear skirt 20 is provided with two ribs 24, located at two opposite sides of the rear aperture 22.

The ribs 24 extend transversally relative to the XX' direction. Each rib 24 forms a guide rail for a rear cap 26. The ribs 24 project perpendicularly to the XX' axis, i.e. toward the sides of the electrical connector, so as to form a stop for the rear cap 26 in the XX' direction.

The rear skirt 20 is also provided with complementary ribs 25 which also extend transversally relative to the XX' direction, but project along the XX' direction, toward the rear face 16 of the connector, so that the complementary ribs 25 form a lateral stop for the rear cap 26, preventing lateral displacement of the rear cap 26.

The ribs 24 and the complementary ribs 25 are alternatively discontinuous. They complement each other, i.e. the discontinuity of the rib 24 corresponds to the presence of the rib 25. This permits their molding.

The rear cap 26 is intended to be mounted on the rear skirt 20 so as to cover the rear aperture 22. The rear cap 26 comprises two lateral walls 26A provided with respective grooves 27 able to cooperate with the ribs 24 of the rear skirt 20. The rear cap 26 is opened on a side between the lateral walls 26A, so as to define a lateral cable entrance 28.

Figure 2:
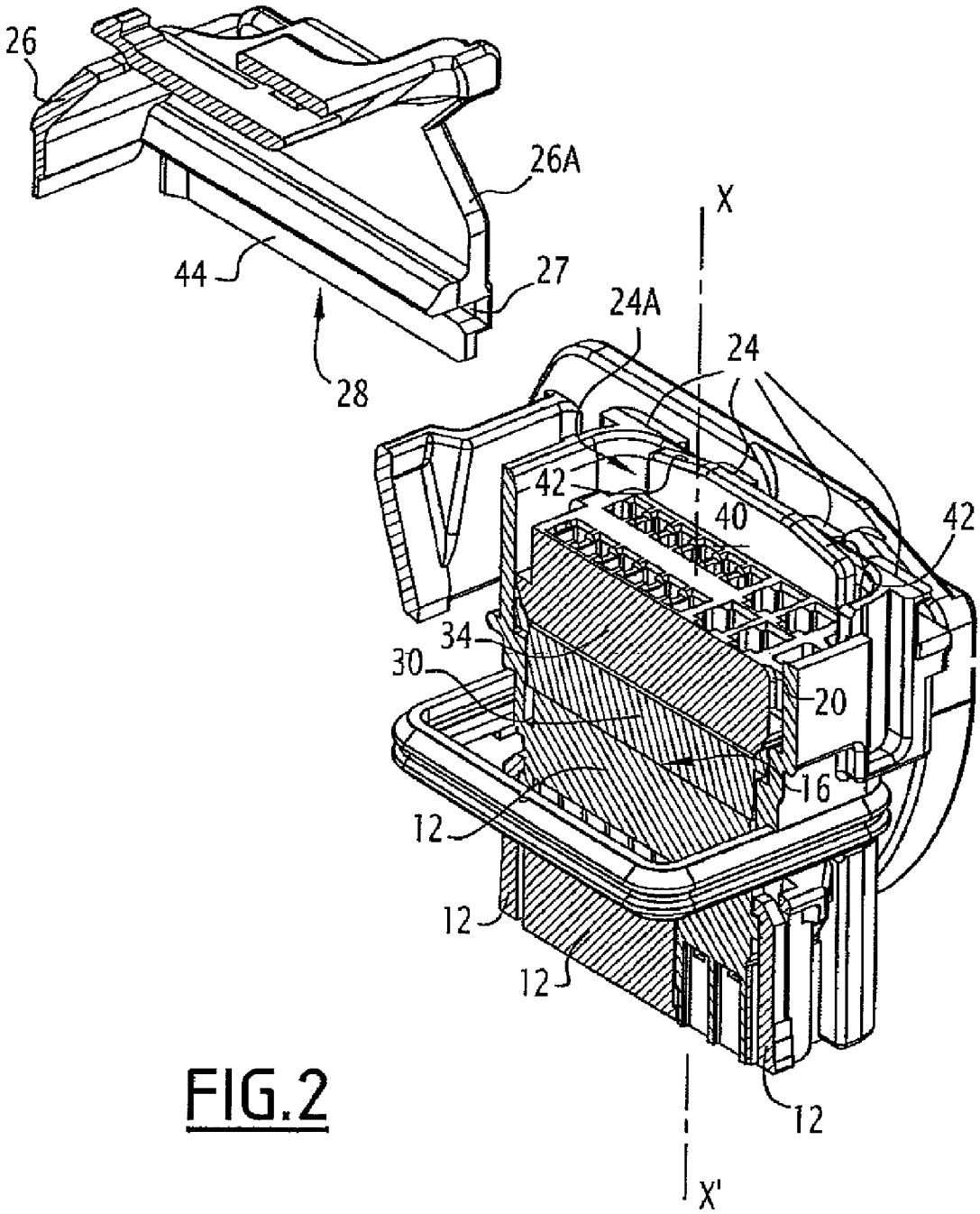
FIG. 2 is a tri-dimensional cross-sectional view along the II plane of FIG. 1, before the electrical connector is assembled.
Figure 3:
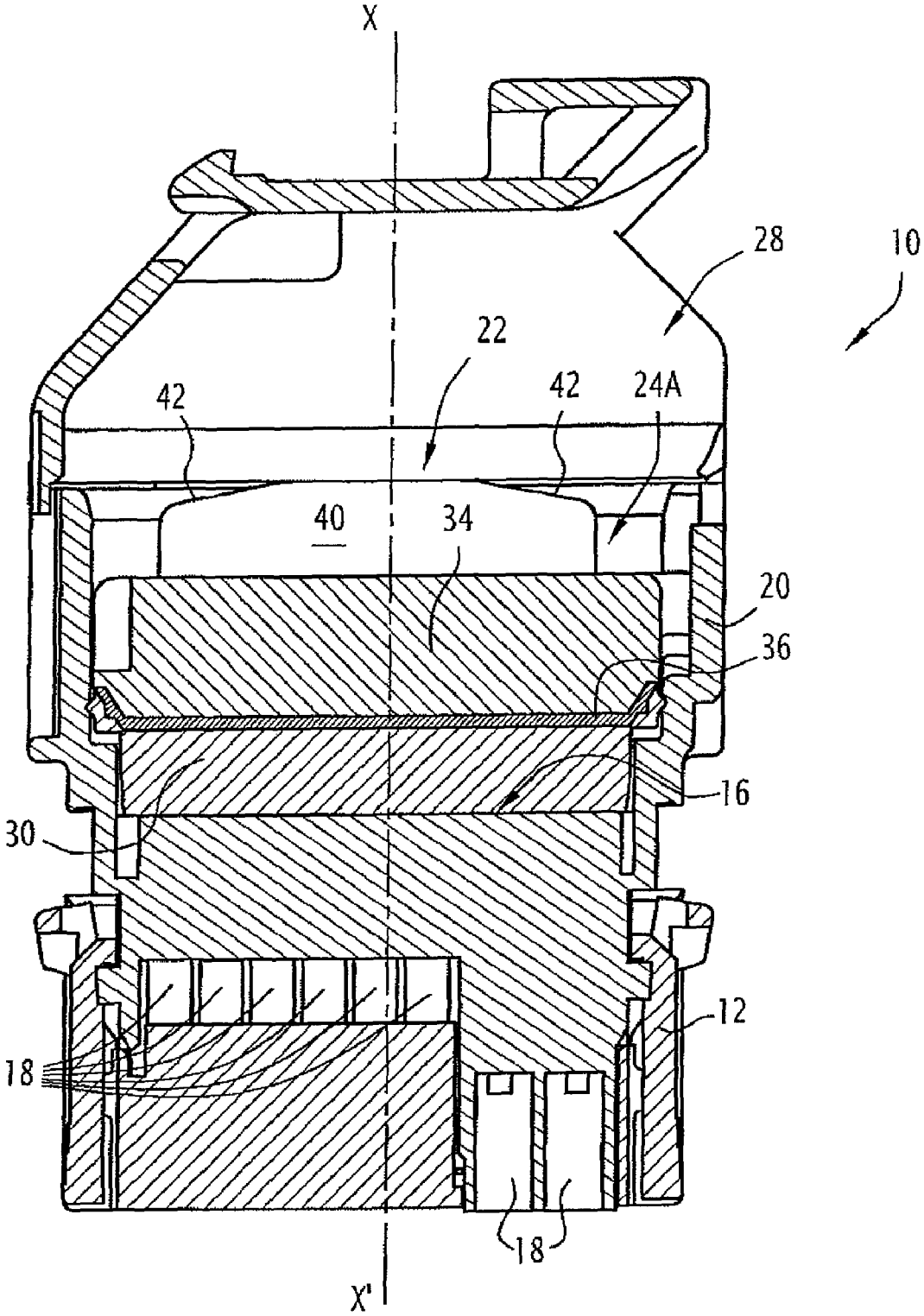
FIGS. 3 and 4 are cross-sectional views along the III, IV plane of FIG. 1, the electrical connector being assembled.
Figure 4:
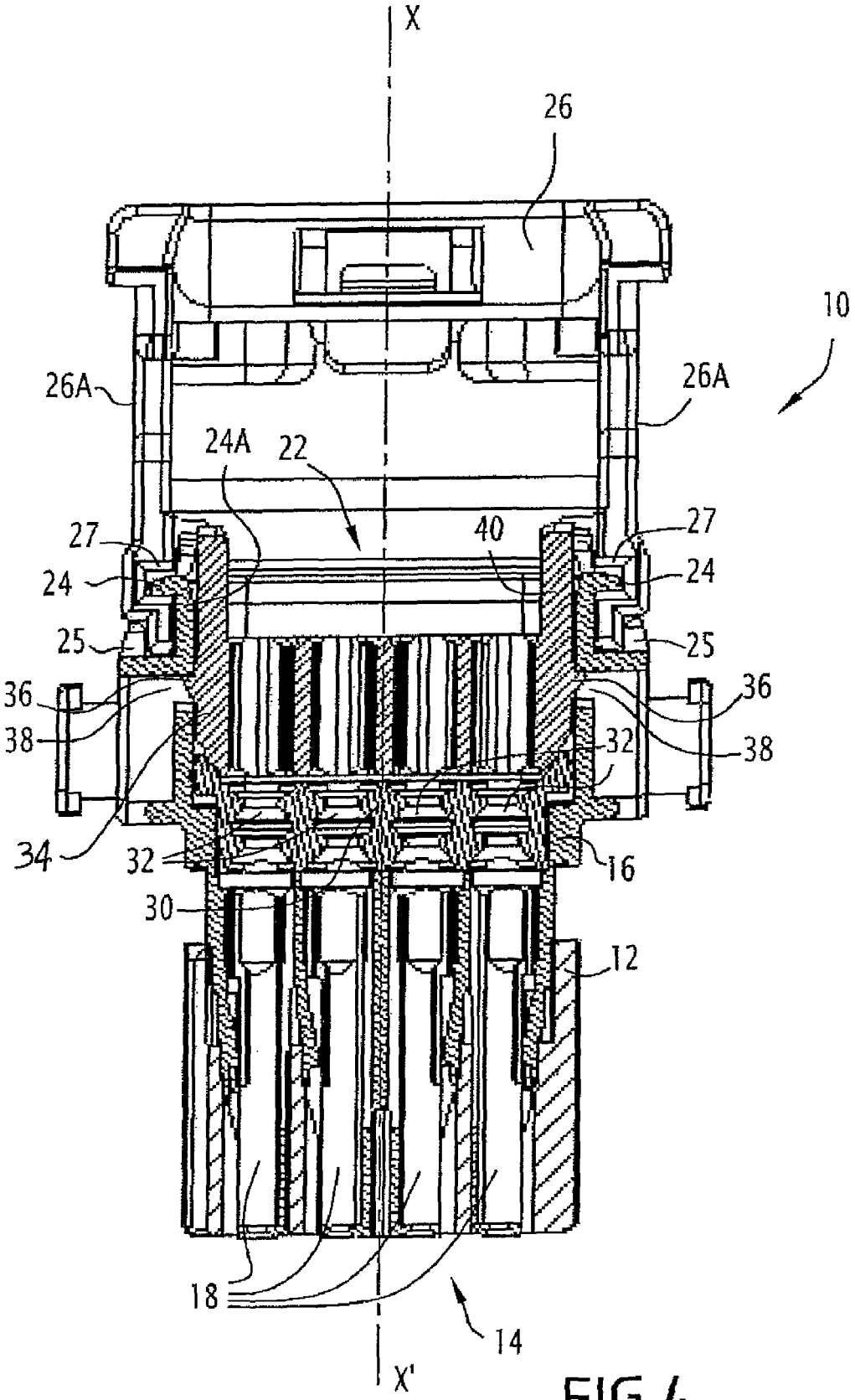

Turning to FIGS. 2, 3 and 4, a mat seal 30, made of elastomer material, is disposed in the rear skirt 20, against the rear face 16. The mat seal 30 is provided with a plurality of cable passages 32 facing the accommodating chambers 18.

As can be seen on FIG. 3, a clearance is provided laterally between the mat seal 30 and the rear skirt 20. In the depicted example, the clearance between the rear skirt 20 and the mat seal 30 is from 0.15 to 0.4 millimeters. The clearance insures that no compression is induced on the mat seal 30 by the rear skirt 20. In this way, the cables may be inserted through the mat seal without deteriorating the mat seal 30, since the mat seal is not compressed. In other words, the clearance that is present when the mat seal is not compressed, allows the enlargement of the passages of the mat seal, when the cables are introduced.

A rear grid 34 is also disposed in the rear skirt 20, against the mat seal 30. The rear grid 34 is provided with a plurality of cable passages 36 facing the cable passages of the mat seal 30.

The rear grid 34 is able to slide along the XX' axis in the rear skirt 20, so as to move forward towards the insulative housing, and in particular towards the rear face 16.

Once the electrical connector 10 is assembled, each cable thus makes a bend inside the rear cap 26, before passing through the rear grid 34 then the mat seal 30, in order to reach an accommodating chamber 18, in which the terminal of the cable lies.

Turning in particular to FIG. 4, the rear grid 34 comprises two opposite peripheral latches 36. Each latch 36 is intended to be received in a corresponding recess 38 arranged on the inner side 20A of the rear skirt 20.

In this way, the recesses 38 form a stop for maintaining the rear grid 34 in a pre-locking position against the mat seal 30, via their cooperation with the latches 36. The pre-locking position is depicted on FIGS. 1 and 2. More precisely, the recesses 38 and the latches 36 prevent the rear grid 34 from moving rearward in the rear skirt 20, away from the rear face 20.

The recesses 38 are placed in the XX' direction so that the rear grid 34 in the pre-locking position does not compress the mat seal 30. The cable passages 32 of the mat seal 30 are thus radially uncompressed, which allow an easy insertion/removing of the cables. Furthermore, the easy insertion/removing prevents deterioration of the mat seal.

The rear grid 34 further comprises two opposite rear flanges 40. Each flange 40 projects rearward with respect to the rear grid 34, along the inner side 20A of the rear skirt 20. The flanges 40 are chamfered at each of their ends, so as to form ramps 42, see FIGS. 1 and 2. The flanges 40 are thus symmetrical.

The flanges 40 are preferably made integral and moulded in a single process with the rear grid. The flanges 40 are thus fixed to the rear grid.

The lateral walls 26A are provided with inner ribs 44 projecting towards the inside of the rear cap 26.

When the rear cap 26 is moved perpendicularly to XX' guided by the ribs 24, the inner ribs 44 hit the ramps 42, which causes the rear grid 34 to slide along the XX' direction, toward the mat seal in the rear skirt 20, thus longitudinally compressing the mat seal 20 against the rear face 16 of the insulative housing 12 until an end position is attained. Since the flanges 30 are symmetrical, the rear cap 26 can be mounted from each extremity of the flanges.

Alternatively, the two flanges 40 can be replaced by a similar but unique flange projecting rearward from a medium line of the rear grid 24 situated between two rows of cable passages and the ribs 44 being replaced by a unique rib projecting toward the grid from a top of the cover 24.

Since the ramps 42 are carried by the rear flanges 40, a great distance between the rear grid 34 and the rear cap 26 is obtained. This great distance permits an easy bending of the cables. The cables are thus less likely to deteriorate. For this purpose, the height of the flange 40 can be between 3 to 10 mm, preferentially between 4 to 5 mm.

Once the end position is attained, the rear cap is locked by using clipping means, such as latches provided on the rear cap, so as to enter corresponding holes provided in the housing 12.

Turning to FIGS. 3 and 4, showing the end position, the compression is maintained while the rear cap 26 covers the rear aperture 22 by the lateral walls 26A of the rear cap 26 forming a stop for the flanges 40, preventing a rear ward sliding of the rear grid 34.

In the end position, the compression of the mat seal 20 along the XX' direction leads to a radial shrinking of its passages 32, which guarantees the sealing of the cables passing trough the seal 30.

More particularly, the mat seal is laterally confined by the rear skirt 20, so that the mat seal first extend against the rear skirt, i.e. until the clearance is filled up, then the passages shrink.

The assembling of the connector 10 is easy, because the mounting of the rear cap 26 automatically induces the sealing of the cables pressing through the mat seal 20.

Similarly, if one needs to remove the cables, the disassembling of the rear cap 26 will let the rear grid 24 free of moving rearward, thus allowing a spring back of the mat seal 20. In this way, the cables may be removed without deteriorating the mat seal 20, which then can be re-used.

It should be noted that, since it is almost impossible to remove the cables without first disassembling the rear cap 26, there is no risk that one would try to remove the cables with the mat seal in a compressed state.

The invention is not limited by the previous described example. For instance, the electrical connector could only have one flange. In another embodiment, the flanges could be carried by the rear cap, and/or have different form.

Furthermore, the guide rails could be formed by grooves instead of ribs. In that case, the lateral walls of the rear cap would be provided with corresponding ribs.

The invention claimed is:

1. An electrical connector comprising:

an insulative housing having:

a front face for being mated with a counterpart electrical connector, and a rear face for inserting cable terminals, a plurality of terminal accommodating chambers, which each open on the rear face for inserting of a respective cable terminal, and open on the front face so that the respective cable terminal accommodated in the accommodating chamber can be connected to a counterpart terminal of the counterpart connector, a mat seal against the rear face, and having a plurality of cable passages facing the accommodating chambers, a rear grid disposed against the mat seal, the rear grid comprising a main section having a plurality of cable passages facing the cable passages of the mat seal, and at least one chamfered flange extending rearward away from the main section, a mobile part, a guide rail fixed to the housing, the guide rail being transverse to the front-rear direction (XX'), for transversally guiding the mobile part, a ramp system such that, when the mobile part is guided by the guide rail, the ramp system pushes the rear grid against the mat seal so as to compress the mat seal, the electrical connector being characterized in that the ramp system is formed by the at least one chamfered flange that rises rearward with respect to the main section of rear grid and that is fixed to the rear grid.

2. The electrical connector according to claim 1, wherein the mobile part is a rear cap covering the rear grid.

3. The electrical connector according to claim 1, comprising a stop for maintaining the rear grid in a pre-locking position against the mat seal.

4. The electrical connector according to claim 3, wherein the rear grid, in the pre-locking position, does not compress the mat seal.

5. The electrical connector according to claim 3, wherein the rear grid comprises a peripheral latch, and the stop is formed by a recess for receiving the latch, the recess being provided in a the rear skirt extending rearward with respect to the rear face.

6. The electrical connector according to claim 1, wherein a clearance is provided between the mat seal and a rear skirt extending rearward with respect to the rear face, when the mat seal is not compressed by the rear grid.

7. An electrical connector comprising:

a housing having a plurality of terminal accommodating chambers, and at least one guide rail;

a mat seal located on the housing and having a plurality of first cable passages facing the terminal accommodating chambers;

a rear grid located against the mat seal, the rear grid comprising a main section having a plurality of second cable passages facing the first cable passages of the mat seal, and at least one flange extending rearward away from the main section, a rearward facing surface of the at least one flange being spaced from the main section of the rear grid and forming a first ramp surface; and a rear cap adapted to be slid on the at least one guide rail to connect to the housing, the rear cap having a second ramp surface, wherein, when the rear cap is moved on the housing towards an assembled position and guided by the at least one guide rail on the housing, the second ramp surface is configured to contact the first ramp surface and push the at least one flange forward into the housing and thereby push the rear grid against the mat seal to compress the mat seal between the housing and the rear grid.

8. The electrical connector as in claim 7 wherein the housing has a latch recess and the rear grid has a latch slidably located in the latch recess between a first pre-latched position and a second latched position.

9. The electrical connector as in claim 7 wherein the at least one flange comprises two flanges located on opposite sides of a rear end of the main section and extending away from the rear end in a general cantilever fashion.

10. The electrical connector as in claim 7 wherein the first ramp surface is chamfered at opposite ends.

11. The electrical connector according to claim 7 comprising a stop for maintaining the rear grid in a pre-locking position against the mat seal.

12. The electrical connector according to claim 11 wherein the rear grid, in the pre-locking position, does not compress the mat seal.

13. The electrical connector according to claim 11 wherein the rear grid comprises a peripheral latch, and the stop is formed by a recess for receiving the latch, the recess being provided in a rear skirt of the housing.

14. The electrical connector according to claim 13 wherein a clearance is provided between the mat seal and the rear skirt when the mat seal is not compressed by the rear grid.

* * * * *